United States Patent [19]

Comploi et al.

[11] Patent Number: 4,580,511

[45] Date of Patent: Apr. 8, 1986

[54] EMBROIDERING MACHINE

[75] Inventors: Georg Comploi, Bludenz; Arthur Loacker, Götzis, both of Austria; Kurt Huber, Arbon, Switzerland; Wilhelm Hutter, Roggwil, Switzerland; Hans Wallimann, Goldach, Switzerland

[73] Assignee: Aktiengesellschaft Adolph Saurer, Arbon, Switzerland

[21] Appl. No.: 657,173

[22] Filed: Oct. 3, 1984

[30] Foreign Application Priority Data

Oct. 6, 1983 [CH] Switzerland ..... 5446/83

[51] Int. Cl.[4] ..... D05C 5/04; D05C 11/06

[52] U.S. Cl. ..... 112/84; 112/85; 112/221

[58] Field of Search ..... 112/84, 85, 78, 79 A, 112/98, 99, 100, 101, 221, 163, 121.11

[56] References Cited

U.S. PATENT DOCUMENTS

| | | | |
|---|---|---|---|
| 4,271,770 | 6/1981 | Heinzle | 112/84 |
| 4,325,313 | 4/1982 | Kawai et al. | 112/221 X |
| 4,426,941 | 1/1984 | Comploi et al. | 112/84 |
| 4,434,728 | 3/1984 | Comploi et al. | 112/84 |
| 4,476,793 | 10/1984 | Conrads et al. | 112/98 X |

*Primary Examiner*—Peter Nerbun

*Attorney, Agent, or Firm*—Werner W. Kleeman

[57] ABSTRACT

A relatively great number of embroidering locations with the appropriate embroidering implements are arranged in at least one row. The embroidering implements are capable of being coupled to and uncoupled from the embroidering implement drive of the embroidering machine according to a predetermined repetition and color-change program by electromagnetic actuation devices. The pattern and machine-function control of the embroidering machine is performed via a data carrier whose reading and evaluation unit controls a pattern and machine-function control device. Data for the repetition and color-change program are also placed on this data carrier for pattern and machine-function control. Suitable further data are also placed on this data carrier for actuating a switch associated with the reading and evaluation unit for transmitting the repetition and color-change program to an embroidering location control device connected to the electromagnetic actuation devices of the embroidering implements. The employment of the same data carrier hitherto employed for pattern and machine-function control also for the repetition and color-change programs, has the great advantage that all devices for introducing or correcting data on the data carrier, for reading such data and for archiving the data carriers can be retained and that there can be used a relatively uncomplicated design for the control switch and the embroidering location control device.

19 Claims, 6 Drawing Figures

ELECTROMAGNETIC ACTUATION DEVICES
13
35
=/≠
36
COMPARATOR STAGE
37
SIGNAL LAMP
7'
6'
7
6
PROCESSOR
15
ROM
16
MULTI-PLEXER
5
9
MACHINE FUNCTION CONTROL DEVICE
17
14
EMBROIDERY LOCATION CONTROL DEVICE
STORAGE MEANS
12
SWITCH MEANS
10
DATA CARRIER
1
11
READING & EVALUATION UNIT

EMBROIDERING MACHINE

CROSS REFERENCE TO RELATED PATENTS AND APPLICATION

This application is related to our commonly assigned, co-pending U.S. patent application Ser. No. 06/657,172, filed Oct. 3, 1984, and entitled "Embroidering Machine". This application is also related to U.S. Pat. No. 4,426,941, granted Jan. 24, 1984 and U.S. Pat. No. 4,434,728, granted Mar. 6, 1984.

BACKGROUND OF THE INVENTION

The present invention broadly relates to embroidering machines and, more specifically, pertains to an embroidering machine having a relatively great number of embroidering locations with translatably guided embroidering implements arranged in at least one row.

Generally speaking, the embroidering machine of the present invention has translatably guided embroidering implements which are capable of being coupled to and uncoupled from an embroidering implement drive means according to a freely programmable repetition and color-change program by means of electromagnetic actuation devices. Pattern and machine-function control at the embroidering machine takes place via a data carrier whose reading and evaluation unit controls a pattern and machine-function control device.

In other words, the embroidering machine of the present invention has a plurality of embroidering locations arranged in at least one row and comprises translatably guided embroidering implements for these embroidering locations, embroidering implement drive means, electromagnetic actuation devices for the embroidering implements and program means for a freely programmable repetition and color-change program. The embroidering implements are capable of being selectively coupled to and uncoupled from the embroidering implement drive means according to the repetition and color-change program by means of the electromagnetic actuation devices. The embroidering machine also comprises a pattern and machine-function control device for controlling pattern and machine-function control operations, a data carrier for the pattern and machine-function control operations and a reading and evaluation unit for reading and evaluating the data carrier for controlling the pattern and machine-function control device. The pattern and machine-function control operations are effected via the data carrier.

Embroidering machines, especially large embroidering machines with possibly more than 1,000 embroidering locations, embroider with various repetitions or repeats and colors according to the type of the pattern, image or figures to be embroidered. As is well known, this requires frequent repetition and color-changing in which the embroidering tools or implements, such as needles, borers, snubbers, or piercers and so forth, of the appropriate embroidering locations must either be re-activated or de-activated.

Various attempts have been made to accelerate such repetition and color-changes, which were formerly effected exclusively manually at a great expense of time, by appropriate actuation means.

For instance, mechanical storage means in the form of punched or perforated tapes or perforated drums are known which can activate or de-activate the most various combinations of needles or embroidering implements by translation or rotation.

Such mechanical storage means are, however, inconvenient to manipulate, relatively expensive and have only a very limited storage capacity.

Apparatuses are also known which can activate or de-activate the individual embroidering implements or embroidering locations by means of electric, pneumatic or hydraulic switching or actuation elements.

The expenditure for supply and control leads, such as conduits or conductors or lines, to the individual implements is relatively high and therefore this solution is still not an economical one.

An improvement constituting a prerequisite for economic repetition and color-changing is known to the art in which all embroidering implements, for instance the needles and borers, of an embroidering location are always commonly activated by means of an electromagnetic apparatus, thus providing an initial considerable reduction of operating and control means.

Such a design of an embroidering machine with electromagnetic embroidering location activation suggests the further introduction of the various repetition and color-change programs into the embroidering machine using modern data processing means. This, however, requires very expensive computer means which are completely foreign to the embroiderer.

SUMMARY OF THE INVENTION

Therefore, with the foregoing in mind, it is a primary object of the present invention to provide a new and improved construction of an embroidering machine which does not exhibit the aforementioned drawbacks and shortcomings of the prior art constructions.

Another and more specific object of the present invention aims at providing a new and improved construction of an embroidering machine of the previously mentioned type in which it is possible to effect repetition and color-change program control by means of operating means of the embroidering machine which are familiar to the embroiderer.

Yet a further significant object of the present invention aims at providing a new and improved construction of an embroidering machine of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the embroidering machine of the present invention is manifested by the features that data for the repetition and color-change program are placed on the same data carrier already provided for pattern and machine-function control. Suitable data are also placed on the data carrier for actuating a switch associated with the reading and evaluation unit for transmitting the repetition and color-change program to an embroidering location control device connected to the electromagnetic actuation devices of the embroidering implements.

The employment, according to the invention, of the same data carrier hitherto employed for pattern and machine-function control also for the repetition and color-change programs, has the great advantage that all devices for introducing or correcting data on the data carrier, for reading such data and for archiving the data carriers can be retained and that there is required relatively uncomplicated design of the equipment for the control switching means and the embroidering location control device.

It is particularly advantageous for the data carrier to be an ordinary punch tape or punch card in which at least one row comprising a plurality of locations for column perforations forms a perforation combination for controlling the machine-functions and wherein one of these perforation combinations which has no machine-function associated with it contains the information or data for actuating the switching means.

This then yields the possibility of employing the existing perforation combination provided for controlling the machine-functions also for the information of the repetition and color-change program as well after the switching means has been switched to the embroidering location control device. The perforation combination for actuating the switching means and the perforation combination for the repeat or repetition and color-change program are placed upon the punch tape or equivalent data carrier in a region in which no machine-functions are selected.

Thus, conventional punch tapes or punch cards hitherto employed as data carriers can be employed without any alteration in the arrangement of perforations. The perforation combinations hitherto employed to contain information for pattern and machine-function control as well as the same perforation combinations further containing information for the repetition and color-change programs can both be applied to the punch tapes by means of the usual perforation devices and are therefore also readable by the existing reading device.

A further advantage of the additional employment of a punch tape, respectively a punch card, as data carrier for the color and repetition-change programs consists in that the combinations of the active and inactive embroidering locations upon the data carrier can easily be read visually from the patterns of perforations and, additionally, the perforation operation can be readily performed and monitored with the help of previously prepared design templates.

For embroidery patterns in which groups of relatively few active, i.e. embroidering, and inactive, i.e. non-embroidering, embroidering locations constantly repeat over the entire width of the machine, respectively over all several hundred embroidering locations, it is advantageous for the perforation combinations for repetition and color-change program information to correspond to a simple and very short numerical code for simple combinations extending uniformly over the entire machine. The corresponding signals of the reading and evaluation device can be conducted via a processor and a subsequently arranged multiplexer of the embroidering location control device to all appropriate embroidering location actuation devices.

Furthermore, as many and as complicated repetition and color-change programs as desired can be processed, especially when the perforation combinations for the information of the repetition and color-change program correspond to numerical codes for selecting storage means containing different needle or embroidering implement combinations or embroidering location combinations. The storage means are associated with a processor of the embroidering location control device. The storage means, such as a read-only memory can be loaded with information for the desired differing needle or embroidering implement combinations from the data carrier before or during the embroidering process.

A significant problem in such embroidering machines having electromagnetic actuation of hundreds of, or even more than 1,000, embroidering locations consists in that a simultaneous selection of all magnets can only be realized at great expense. On the one hand, a momentarily great amount of electrical power would be required to switch the more than 1,000 magnets and, on the other hand, the wiring would involve enormous costs and would be correspondingly voluminous. Also a sequential switching of the embroidering locations can not be considered practical, since this requires a considerable amount of time, which runs counter to a rational or efficient operation of the embroidering machine.

Therefore, according to the invention, a so-called group-switching of the embroidering locations, respectively of their electromagnets, is performed such that groups of a few embroidering locations, respectively their electromagnetic actuation devices, form switching groups or units. The electromagnetic actuation devices of each switching unit are connected in parallel at their input sides. An input conductor or line common to the switching unit connects them to the embroidering location control device. A number of output conductors or lines corresponding to the number of electromagnetic actuation devices per switching unit connects the individual electromagnetic actuation devices at their output sides in series with the embroidering location control device.

In other words, each switching unit is provided with its own common input conductor or line. All electromagnetic actuation devices of each switching unit are connected in parallel at their input sides to the common input conductor of the respective switching unit and, via the common input conductor, in parallel to the embroidering location control device. Each switching unit is further provided with individual output conductors or lines for each electromagnetic actuation device of the switching unit. These individual output conductors are each common to all switching units. Mutually corresponding electromagnetic actuation devices of every switching unit are connected in parallel at their output sides with the respective individual output conductor and, via these individual output conductors, in series to the embroidering location control device.

A minimum of electrical conductors and a very rapid switching of all switching groups is attained with a minimum of power consumption by these measures and by an optimum choice of the number of grouped embroidering locations, in this case for instance four per switching unit.

In particular, if complicated and rapidly changing repetition and color-change programs with correspondingly comprehensive readjustment of the several hundred embroidering locations between active and the inactive positions are employed, it is practically impossible for the personnel to supervise the correct actuation of all embroidering locations.

Therefore, according to the invention, a further embodiment of the embroidering machine previously described consists in that a circuit generating electrical pulses is provided at each embroidering location, or for each switching unit, for monitoring the actuation of the embroidering locations in accordance with the control signals of the embroidering location control device. The output signals of this circuit act as momentary actual values for a comparator stage which compares the latter with a reference or set value generated by the embroidering location control device and, if appropriate, generates an error signal. The momentary actual value generator can, for instance, be an ammeter or the like arranged at the output-side output conductor of the electromagnetic actuation device of each embroidering location.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof only enough of the structure of the embroidering machine has been illustrated therein as is necessary to enable one skilled in the art to readily understand the underlying principles and concepts of this invention.

Figure 1:
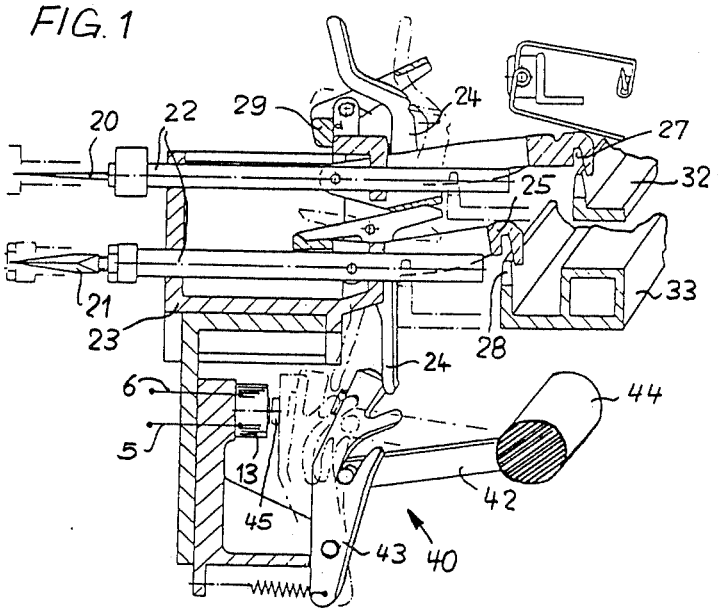
FIG. 1 shows a schematic side view of an embroidering location with a needle and a borer as embroidering implements in a conventional embroidering machine.
Figure 3:
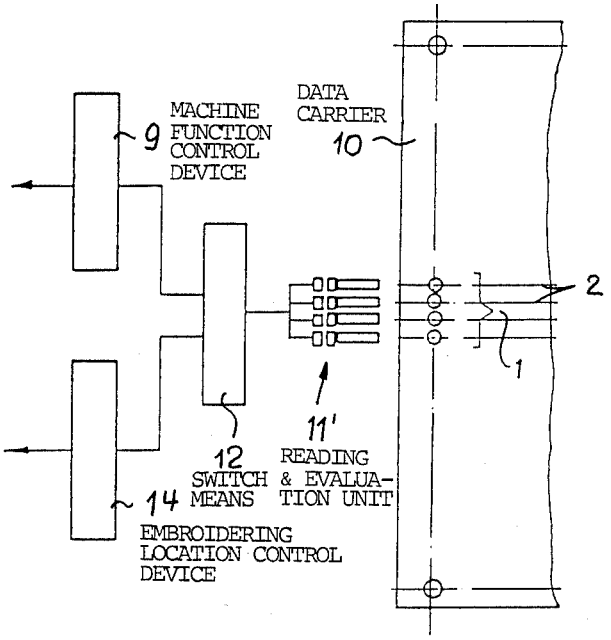
FIG. 3 is a function diagram of a reading device for the data carrier of the arrangement according to FIG. 2.

Turning attention now specifically to FIG. 1 of the drawings, the apparatus illustrated therein by way of example and not limitation is represented by one embroidering location of the embroidering machine, which may have more than 1,000 such embroidering locations. The illustrated embroidering location comprises two embroidering tool or implement rods or bars 22 arranged one above the other and carrying different embroidering implements, for instance a needle 20 and a borer 21. The embroidering implement rods 22 are mounted in a stationary component 23 of the machine and are oscillatable along their longitudinal axes. They are also capable of being coupled to and uncoupled from the associated embroidering tool or implement drive rail 32, respectively 33, by means of a common switching lever 24.

The switching lever 24 can be operated manually or by means of an electromagnetic actuation device 13 either directly or via manual positioning arm means 29. The electromagnetic actuation device 13 here forms part of a positioning device 40 for the switching lever 24. The pawl lever 43 of the switching lever 24 carries a permanent magnet 45 at one of its free ends which is continuously attracted by the non-energized electromagnets of the electromagnetic actuation device 13.

Furthermore, the construction of this embroidering location is such that a pawl 25 is hinged to each embroidering implement rod 22 and has a downwardly opening groove or recess 27 at its free end for engaging a coupling protrusion or nose 28 on the appropriate implement drive rail 32 or 33.

In order to now be able to select any desired new repetition or pattern repeat, first all appropriate pawl levers 43 are brought out of their operative positions into an intermediate position by pivoting a switching rod or bar 42 of the positioning device 40 seated upon a machine shaft 44, whereupon the pawl levers 43 automatically traverse the remaining distance into the idle position under the influence of the magnetic field between the permanent magnet 45 and electromagnetic actuation device 13. All embroidering implements are therefore then in their embroidering, i.e. operative, working position.

For a new repetition or pattern repeat, all of those electromagnets of the electromagnetic actuation devices 13 which are situated at embroidering locations which will not embroider in the new repetition or pattern repeat are now energized. The corresponding embroidering implements are then simultaneously placed in their inoperative position by the switching lever 24.

As previously mentioned, an embroidering machine with such embroidering locations is known to the art in which appropriately designed embroidering locations make it is possible for all embroidering implements, for instance the needles and borers, of an embroidering location to always be commonly activated by means of an electromagnetic apparatus, thus providing an initial considerable reduction of operating and control means.

Figure 2:
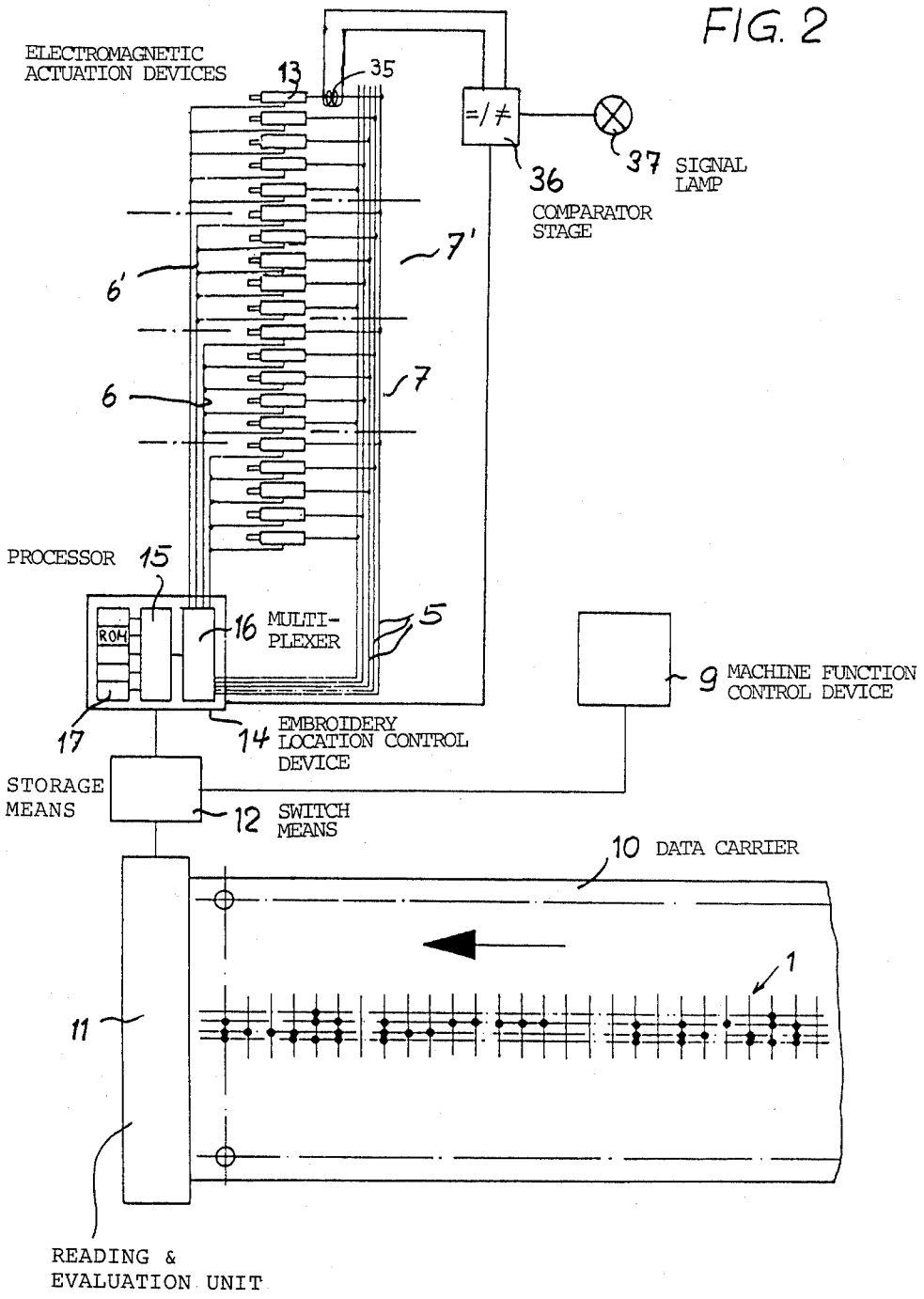
FIG. 2 shows a function diagram of an embroidering machine according to the invention and having a data carrier, a pattern and machine-function control device and an embroidering location control device.

In order to construct an embroidering machine of the previously mentioned type such that it is possible to effect repetition and color-change program control essentially by means of operating means of the embroidering machine which are familiar to the embroiderer, the embodiment of the invention according to FIG. 2 is constructed such that, upon an already existing data carrier 10 provided for a pattern and machine-function control device 9, which is only summarily indicated here and which can be considered to be known as such and need therefore not be here explained in greater detail, data for the repetition and color-change program are also placed. Suitable further data are also placed on this data carrier for actuating a switch 12 associated with the reading and evaluation unit 11 for transmitting the repetition and color-change program to an embroidering location control device 14 connected to the electromagnetic actuation devices 13 of the embroidering implements, as will be explained in more detail in the following.

As can be further seen from FIG. 2, all embroidering locations, respectively their electromagnetic actuation devices 13, are connected by corresponding input and output conductors 5 and 6 to the embroidering location control device 14.

As was already initially described, a significant problem in such embroidering machines having electromagnetic actuation of hundreds of, or even more than 1,000, embroidering locations consists in that a simultaneous selection of all magnets is practically not possible. On the one hand, a momentarily great amount of electrical power would be required to switch the more than 1,000 magnets and, on the other hand, the wiring would involve enormous costs and be correspondingly voluminous. A sequential switching of the embroidering locations also can not be considered practical, since this requires a considerable amount of time, which runs counter to a rational or efficient operation of the embroidering machine.

Therefore, according to the invention and as clearly shown in FIG. 2, a so-called group-switching of the embroidering locations, respectively of their electromagnetic actuation devices 13, is effected such that individual embroidering locations, respectively their electromagnetic actuation devices 13, form switching groups or units 7, 7'. The electromagnetic actuation devices 13 of each switching unit 7, respectively 7', are connected in parallel at their input sides and, via an input conductor 6, respectively 6', common to the switching unit, to the embroidering location control device 14. The individual electromagnetic actuation devices 13 of all switching units 7, 7' are connected at their output sides by a number of output conductors 5 corresponding to the number of electromagnetic devices 13 per switching unit 7, respectively 7', in series to the embroidering location control device 14.

A minimum of electrical conductors and a very rapid switching of all switching groups or units is attained with a minimum of power consumption by these measures and by an optimum choice of the number of grouped embroidering locations, in this case for instance four per switching unit.

As already previously mentioned, the employment of the same data carrier hitherto employed for pattern and machine-function control for the repetition and color-change programs as well, has the great advantage that all devices for introducing or correcting data on the data carrier, for reading such data and for archiving the data carriers can be retained and that the equipment expenditure for the control switching means and the embroidering location control device is relatively modest.

Figure 4:
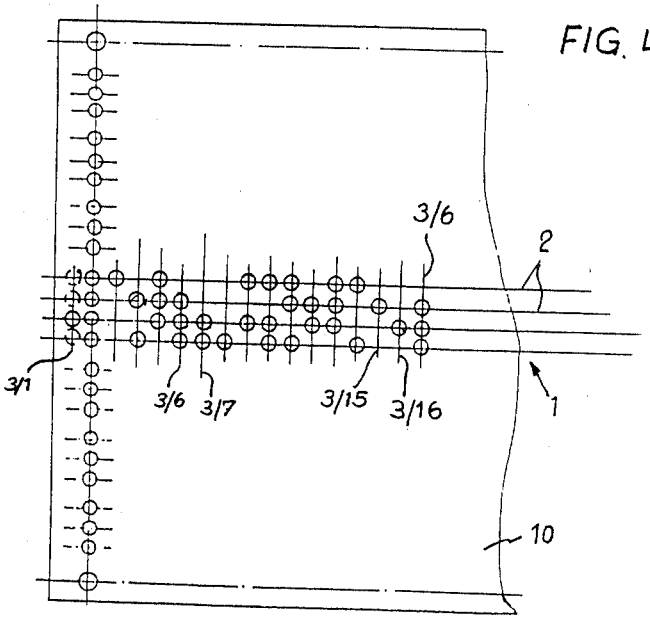
FIG. 4 shows the data carrier in the form of a punch tape.

It is of particular advantage for the data carrier 10 to be a punch tape or perforated strip as illustrated in the FIGS. 2 through 5, i.e. a so-called punch card, which comprises in known manner and among other things a perforation zone 1 approximately in the middle of the tape with several, here four, perforation columns 2, which form the, here sixteen, perforation combinations 3/1 through 3/16 for controlling the machine-function control device 9, as can be particularly well seen in FIG. 4.

It is to be assumed that the perforation combinations illustrated in the sequence 3/1 to 3/5 and 3/7 to 3/16, which, of course, may also be arranged in any other sequence, represent any machine-functions, such as needleroll, coupling, bore depth determination and the like, while, for instance, the perforation combination 3/6 represents an information location not employed for machine-functions (blind data).

According to the invention, this blind data 3/6 is exploited to actuate the switch 12.

As can be further seen from FIG. 4, the perforation combinations 3/7 to 3/16 and 3/1 to 3/5 provided for the selection of the machine-functions then form, after the switch 12 has been switched to the embroidering location device 14, for instance by the perforation combination 3/6, information for a repetition and color-change program, until the switch 12 is switched back to the machine-function control device 9 by means of a further perforation combination 3/6 placed upon the data carrier 10. In the illustration according to FIG. 4, this further perforation combination 3/6 appears immediately following the perforation combination 3/16 and accordingly the perforation combinations 3/1 to 3/5 and 3/7 to 3/16 again control the machine-function.

Thus, conventional punch tapes or punch cards hitherto employed as data carriers can be employed without any alteration of the arrangement of perforations. The perforation combinations hitherto employed to contain information for pattern and machine-function control as well as now additionally the same perforation combinations further containing information for the repetition and color-change programs can both be applied to or placed upon the punch tapes by means of the usual perforating devices and are therefore also readable by the existing reading device 11', as is shown in detail in FIG. 3.

Figure 5:
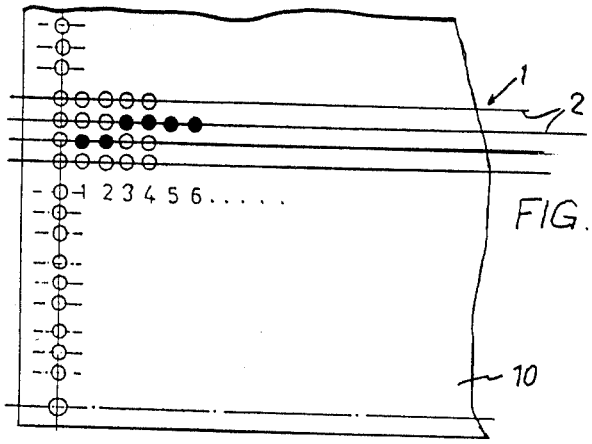
FIG. 5 shows the data carrier according to FIG. 4 with a predetermined perforation array.
Figure 6:
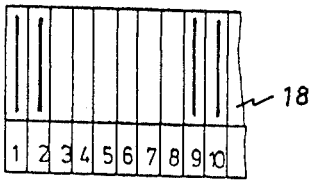
FIG. 6 shows, in partial view, a design template for placing the information or data upon the data carrier according to FIG. 5.

A further advantage of the additional employment of a punch tape, respectively a punch card, as data carrier for the repetition and color-change programs consists in that the combinations of the active and inactive embroidering locations upon the data carrier 10 can be readily read visually from the perforation patterns and additionally, as is indicated in FIG. 5, the perforation operation can be readily performed and monitored with the help of previously prepared registering design templates 18 according to FIG. 6.

In this relation, a considerable simplification in programming and monitoring results from the fact that all embroidering locations on the machine, from the first to the last needle, can be clearly visibly numbered with consecutive numbers, which numeration then agrees with that upon the design template 18 (FIG. 6).

The pitch of the perforations upon the design template 18 preferably comprises the same spacing as the row or line pitch or spacing upon the data carrier 10 in order to permit direct visual comparison for checking purposes. For irregular needle or embroidering implement combinations, only the perforation columns, for instance both inner columns, for the switching functions "embroidering location operative" and "embroidering location inoperative" need be considered, as FIG. 5 and the corresponding design template 18 in FIG. 6 show. This procedure permits a simple and comprehensible pre-programming of repetition and color-change control. The corresponding perforation combinations are placed upon the punch card in a region in which no machine-functions are selected.

For embroidery patterns in which groups of relatively few active, i.e. embroidering, and inactive, i.e. non-embroidering, embroidering locations constantly repeat over the entire width of the machine, respectively over all several hundred embroidering locations, it is advantageous for the perforation combinations 3/1 to 3/5 and 3/7 to 3/16 for repetition and color-change program information according to FIG. 4 to correspond to a simple and very short numerical code for simple combinations extending uniformly over the entire machine. The corresponding signals of the reading and evaluation device 11 can be conducted via a processor 15 and a subsequently arranged multiplexer 16 of the embroidering location control device 14 to all appropriate embroidering location actuation devices 13.

If the pattern repetition requires, for instance, a spacing of 12 needles, wherein four colors are to be alternatingly embroidered, then it can be determined by the simple and short number sequence 12 03 that embroidering will be effected with the third needle, respectively third color, over the entire machine at the spacing of 12 needles. If a suitable computing program is built into the processor 15, then such simple and regularly repetitive needle repetitions can be stored upon the data carrier 10 with minimum space (four rows or lines) even though the combination of active, i.e. embroidering, and inactive, i.e. non-embroidering, embroidering implements for over 1,000 embroidering locations is defined by this simple code. In this manner, such regular repetitions can be read in from the data carrier 10 during the embroidering process and transmitted to the electromagnetic actuation devices 13 via the embroidering location control 14 without idle time and without requiring storage space in the storage means 17.

Furthermore, as many and as complicated repetition and color-change programs as desired can be processed, especially when the aforementioned perforation combinations for the information of the repetition and color-change program correspond to numerical codes for selecting storage means 17 containing different needle or embroidering implement combinations or embroidering location combinations. The storage means 17 are associated with the processor 15 of the embroidering location control device 14. The storage means 17 can be loaded with the desired differing needle or embroidering implement combinations from the data carrier 10 before or during the embroidering process.

The storage means 17, the processor 15 and the multiplexer 16 can be of entirely conventional construction and the processor 15 with its programming keyboard permits a direct programming of the storage registers recallable with the perforation combinations for repetition and color-change control. Such modules are known and therefore need not be explained in more detail here. The operator portion of the previously mentioned programming means should preferably comprise at least visual displays or monitors which permit monitoring the embroidering location combinations that are input into the storage registers and, if necessary, their correction or alteration.

In this manner it is, for instance, possible to input a particular embroidering location combination into a storage register with a defined address both by means of the processor 15 and by means of a suitable perforation combination upon the data carrier 10. For instance, with a command sequence:

3/6 (switching to repetition and color-change control);

numerical code with the perforation combinations 3/7 to 3/16; and return perforation combination 3/6;

according to FIG. 4, a subsequent combination can be input into the storage register with the address corresponding to the numerical code that is input. The stored repetition and color-change information can then be transmitted to the embroidering location control device 14 by a further code.

This embodiment of an embroidering machine according to the invention permits, as can readily be seen, a heretofore inconceivable multiplicity of design possibilities through practically unlimitably storable and recallable needle or embroidering implement combinations, respectively embroidering location combinations which lends new dimensions to such an embroidering machine.

The reading-in of the irregular needle combinations from the data carrier 10 can additionally be effected both before the embroidering procedure during the set-up time of the machine and also during the embroidering procedure in portions of the data carrier which contain no machine-functions.

In particular, if complicated and rapidly changing repetition and color-change programs with correspondingly comprehensive readjustment of the several hundred embroidering locations between active and the inactive positions are employed, it is practically impossible for the personnel to supervise the correct actuation of all embroidering locations.

Therefore, according to the invention, a further embodiment of the embroidering machine previously described consists in that a circuit generating electrical pulses is provided at each embroidering location, or for each switching unit 7 or 7', for monitoring the actuation of the embroidering locations in accordance with the control signals of the embroidering location control device 14. The output signals of this circuit act as momentary actual values for a comparator stage 36 which compares the latter with a reference or set value generated by the embroidering location control device 14 and, if appropriate, generates an error signal. The momentary actual value generator 35 can, for instance, be an ammeter in the output-side output conductor 5 or 5' of the electromagnetic actuation device 13 of each embroidering location. The error signal can, for instance, act upon a signal lamp or other suitable indicator device 37, as can be seen in FIG. 2.

In this embodiment, the momentary actual value generator 35 is a current sensor arranged on the output-side output conductor 5 or 5' of the electromagnetic actuation devices 13 of each embroidering location.

A similar arrangement in which the momentary actual value generator 35 is a sensor cooperating with the switching pawl 25 at the corresponding embroidering location according to FIG. 1, for instance in the form of a not particularly shown optical detector or the like, is considerably more complicated but, on the other hand, is functionally more comprehensive.

An embroidering machine of the most modern design therefore results from the previous description which is able to fulfill all requirements for universal pattern repeat or repetition and color-change control in respect of user-friendliness and wherein, of course, there exists the opportunity for a great amount of variation of operative means utilizable, especially in relation to the processor 15, without departing from the essential concepts and teachings of the invention.

While there are shown and described present preferred embodiments of the invention, it is to be distinctly understood that the invention is not limited thereto, but may be otherwise variously embodied and practiced within the scope of the following claims. Accordingly,

What we claim is:

1. An embroidering machine having a plurality of embroidering locations arranged in at least one row, comprising:

translatably guided embroidering implements for said embroidering locations;

embroidering implement drive means cooperating with said embroidering implements;

electromagnetic actuation devices for said embroidering implements;

said embroidering implements being capable of being selectively coupled to and uncoupled from said embroidering implement drive means according to a predetermined repetition and color-change program containing predetermined data by means of said electromagnetic actuation devices;

a pattern and machine-function control device for controlling pattern and machine-function control operations by means of a data carrier containing data for said pattern and machine-function control operations;

a reading and evaluation unit for reading and evaluating said data carrier for controlling said pattern and machine-function control device;

said predetermined data of said repetition and color-change program being placed upon said data carrier in addition to existing data provided for said pattern and machine-function control operations;

an embroidering location control device connected to said electromagnetic actuation devices of said embroidering implements;

switch means associated with said reading and evaluation unit for transmitting said data of said repetition and color-change program to said embroidering location control device; and said data carrier containing switching information for actuating said switch means.

2. The embroidering machine as defined in claim 1, wherein:

said data carrier comprises a punch-card;

said punch-card being provided with rows of locations for punched perforations;

each said row comprising a plurality of columns of column locations for punched perforations;

at least one row of said plurality of rows forming a predetermined perforation combination for selecting said machine-function control operation; and at least one other row of said plurality of rows devoid of any assigned machine-function containing said switching information for actuating said switch means.

3. The embroidering machine as defined in claim 2, wherein:

other functions for actuating said repetition and color-change program are associated with said predetermined perforation combination formed by said at least one row for selecting said machine-function control operation after said switch means has been switched to said embroidering location control device.

4. The embroidering machine as defined in claim 3, wherein:

said data carrier has a region devoid of said existing data for selecting machine-functions; and said predetermined perforation combination for selecting said machine-function control operation and said predetermined data for said repetition and color-change program being placed upon said data carrier at said region thereof.

5. The embroidering machine as defined in claim 3, wherein:

said predetermined perforation combination which has associated with it said other functions for actuating said repetition and color-change program corresponds to a simple and very short numerical code when said predetermined perforation combinations comprise simple embroidering combinations extending regularly over the entire embroidering machine;

said reading and evaluation unit generating signals corresponding to said numerical code;

predetermined ones of said electromagnetic actuation devices constituting momentarily appropriate embroidering location actuation means;

a processor operatively associated with said embroidering location control device;

a multiplexer operatively associated with said embroidering location control device and connected subsequent to said processor; and said signals corresponding to said numerical code being capable of being conducted to all momentarily appropriate embroidering location actuation means via said processor and said multiplexer.

6. The embroidering machine as defined in claim 3, further including:

a plurality of data storage means;

each said data storage means of said plurality of data storage means being capable of being loaded with information representing a desired combination of said embroidering implements from said data carrier previous to the embroidering process;

each said data storage means containing a different combination of said embroidering implements;

said embroidering location control device including a processor associated with said plurality of data storage means; and said predetermined perforation combination which has associated with it said other functions for actuating said repetition and color-change program defining a numerical encoding for selecting one data storage means of said plurality of data storage means.

7. The embroidering machine as defined in claim 3, further including:

a plurality of data storage means;

each said data storage means of said plurality of data storage means being capable of being loaded with information representing a desired combination of said embroidering implements from said data carrier during the embroidering process;

each said data storage means containing a different combination of said embroidering implements;

said embroidering location control device including a processor associated with said plurality of data storage means; and said predetermined perforation combination which has associated with it said other functions for actuating said repetition and color-change program defining a numerical encoding for selecting one data storage means of said plurality of data storage means.

8. The embroidering machine as defined in claim 3, further including:

a plurality of data storage means;

each said data storage means of said plurality of data storage means being capable of being loaded with information representing a desired combination of said embroidering implements from said data carrier previous to the embroidering process;

each said data storage means containing a different combination of embroidering locations;

said embroidering location control device including a processor associated with said plurality of data storage means; and said predetermined perforation combination which has associated with it said other functions for actuating said repetition and color-change program defining a numerical encoding for selecting one data storage means of said plurality of data storage means.

9. The embroidering machine as defined in claim 3, further including:

a plurality of data storage means;

each said data storage means of said plurality of data storage means being capable of being loaded with information representing a desired combination of said embroidering implements from said data carrier during the embroidering process;

each said data storage means containing a different combination of embroidering locations;

said embroidering location control device including a processor associated with said plurality of data storage means; and said predetermined perforation combination which has associated with it said other functions for actuating said repetition and color-change program defining a numerical encoding for selecting one data storage means of said plurality of data storage means.

10. The embroidering machine as defined in claim 1, wherein:

predetermined individual embroidering locations of all of said plurality of embroidering locations form switching units;

each switching unit of said switching units including at least one of said electromagnetic actuation devices for each embroidering location in each said switching unit;

each of said electromagnetic actuation devices having an input side and an output side;

each said switching unit having a common input conductor for said electromagnetic actuation devices thereof;

said electromagnetic actuation devices of each said switching unit being connected in parallel to said common input conductor at said input sides thereof and via said common input conductor to said embroidering location control device;

all of said switching units having in common a number of individual output conductors corresponding to the number of electromagnetic actuation devices in each said switching unit; and each said electromagnetic actuation device of all of said switching units being connected in series with said embroidering location control device at said output sides thereof via said individual output conductors.

11. The embroidering machine as defined in claim 1, wherein:

predetermined individual electromagnetic actuation devices of all of said plurality of embroidering locations form switching units;

each switching unit of said switching units including at least one of said electromagnetic actuation devices for each embroidering location in each said switching unit;

each of said electromagnetic actuation devices having an input side and an output side;

each said switching unit having a common input conductor for said electromagnetic actuation devices thereof;

said electromagnetic actuation devices of each said switching unit being connected in parallel to said common input conductor at said input sides thereof and via said common input conductor to said embroidering location control device;

all of said switching units having in common a number of individual output conductors corresponding to the number of electromagnetic actuation devices in each said switching unit; and each said electromagnetic actuation device of all of said switching units being connected in series with said embroidering location control device at said output sides thereof via said individual output conductors.

12. The embroidering machine as defined in claim 10, further including:

a comparator stage;

said embroidering location control device transmitting control signals to said embroidering locations;

a sensor generating an electrical pulse output signal and provided for each said embroidering location for monitoring actuation of said embroidering locations in correspondence to said control signals of said embroidering location control device;

said output signal of said sensor defining a momentary actual value for said comparator stage;

said embroidering location control device generating a reference value; and said comparator stage comparing said momentary actual value with said reference value and generating an error signal in the presence of a discrepancy therebetween.

13. The embroidering machine as defined in claim 11, further including:

a comparator stage;

said embroidering location control device transmitting control signals to said embroidering locations;

a sensor generating an electrical pulse output signal and provided for each said embroidering location for monitoring actuation of said embroidering locations in correspondence to said control signals of said embroidering location control device;

said output signal of said sensor defining a momentary actual value for said comparator stage;

said embroidering location control device generating a reference value; and said comparator stage comparing said momentary actual value with said reference value and generating an error signal in the presence of a discrepancy therebetween.

14. The embroidering machine as defined in claim 10, further including:

a comparator stage;

said embroidering location control device transmitting control signals to said embroidering locations;

a sensor generating an electrical pulse output signal and provided for each said switching unit for monitoring actuation of said embroidering locations in correspondence to said control signals of said embroidering location control device;

said output signal of said sensor defining a momentary actual value for said comparator stage;

said embroidering location control device generating a reference value; and said comparator stage comparing said momentary actual value with said reference value and generating an error signal in the presence of a discrepancy therebetween.

15. The embroidering machine as defined in claim 11, further including:

a comparator stage;

said embroidering location control device transmitting control signals to said embroidering locations;

a sensor generating an electrical pulse output signal and provided for each said switching unit for monitoring actuation of said embroidering locations in correspondence to said control signals of said embroidering location control device;

said output signal of said sensor defining a momentary actual value for said comparator stage;

said embroidering location control device generating a reference value; and said comparator stage comparing said momentary actual value with said reference value and generating an error signal in the presence of a discrepancy therebetween.

16. The embroidering machine as defined in claim 12, wherein:

said momentary actual value sensor comprises a current sensor generating an electrical pulse output signal; and said current sensor being situated in at least one of said individual output conductors.

17. The embroidering machine as defined in claim 13, wherein:

said momentary actual value sensor comprises a current sensor generating an electrical pulse output signal; and said current sensor being situated in at least one of said individual output conductors.

18. The embroidering machine as defined in claim 14, wherein:

said momentary actual value sensor comprises a current sensor generating an electrical pulse output signal; and said current sensor being situated in at least one of said individual output conductors.

19. The embroidering machine as defined in claim 15, wherein:

said momentary actual value sensor comprises a current sensor generating an electrical pulse output signal; and said current sensor being situated in at least one of said individual output conductors.

* * * * *